US006546079B2

(12) United States Patent
Fritsch

(10) Patent No.: US 6,546,079 B2
(45) Date of Patent: Apr. 8, 2003

(54) ROTARY ANODE WITH COMPACT SHIELDING ARRANGEMENT

(75) Inventor: Wolfgang Fritsch, Uetersen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 4 days.

(21) Appl. No.: 09/928,538

(22) Filed: Aug. 13, 2001

(65) Prior Publication Data

US 2002/0021783 A1 Feb. 21, 2002

(30) Foreign Application Priority Data

Aug. 14, 2000 (EP) ..... 00202848

(51) Int. Cl.[7] ..... H01J 5/18
(52) U.S. Cl. ..... 378/140; 378/143
(58) Field of Search ..... 378/140, 141, 378/143, 144, 203, 313

(56) References Cited

U.S. PATENT DOCUMENTS 6,091,799 A * 7/2000 Schmidt ..... 378/113

FOREIGN PATENT DOCUMENTS

DE 4429910 A1 7/1995 ..... H01J/35/16

* cited by examiner

*Primary Examiner*—Drew A. Dunn
*Assistant Examiner*—Courtney Thomas
(74) *Attorney, Agent, or Firm*—John Vodopia

(57) ABSTRACT

An X-ray tube (40) including a rotary anode (44) a cathode (1) and compact shielding means (5) for effective shielding against undesired secondary radiation. The secondary radiation is produced in the vicinity of the emitting surface (11) of a target disk (4) of the rotary anode (44) and comprises both electron and X-ray components. The undesired secondary radiation emanates in a certain limited solid angle from the emitting surface of the target disk. Therefore, in order to optimize the shielding properties of the shielding means (5) the latter are positioned in the direct vicinity of the source of the secondary radiation. In order to intercept the undesired secondary radiation emanating towards the rotation axis (12) of the rotary anode, the latter is equipped with a ring-like projection (7).

10 Claims, 3 Drawing Sheets

ROTARY ANODE WITH COMPACT SHIELDING ARRANGEMENT

FIELD OF THE INVENTION

The invention relates to the field of X-ray technology, in particular to an X-ray tube comprising a tube housing, a rotary anode having a target disk rotatable around a rotation axis, a cathode for producing a beam of electrons for generating X-rays upon impingement of said beam of electrons upon an emitting surface of the rotary anode, shielding means for intercepting undesired secondary radiation originating from said emitting surface.

BACKGROUND OF THE INVENTION

An X-ray tube of this type is known form 0,009,946 EP. The known X-ray tube is provided with shielding means which are substantially X-ray opaque said means being manufactured in the shape of envelope. In the known X-ray tube the envelope contains the rotary anode target disk and is provided with an entry window to admit the electron beam originating from the cathode and an exit window for emitting the useful X-ray beam. The X-ray beam is produced by impingement of said electron beam on the target disk of the rotary anode at the focal spot area and will be further referred to as secondary radiation. The focal spot area of the rotary anode constitutes a part of the emitting surface of the target disk of the rotary anode. The X-ray beam emanates from the emitting surface in substantially $2\pi$ solid angle. Only that part of the X-ray beam, which is transmitted through the exit window, contributes to the useful X-ray radiation of the X-ray tube. The remaining part of the X-ray beam contributes to the undesired secondary radiation. It is known that part of the primary electrons undergo scattering on the target disk. These scattered electrons contribute to the undesired secondary radiation as well. In the known X-ray tube the undesired secondary radiation is intercepted by the envelope. A drawback of the known X-ray tube is that the shielding means constitute a tube housing at the same time, increasing the actual volume of the shielding means and thus the amount and weight of the used material. Further, the manufacturing of the material which is suitable for shielding purposes is expensive and causes a substantial environmental load.

SUMMARY OF THE INVENTION

It is a purpose of the invention to provide an X-ray tube with effective and compact shielding against the undesired secondary radiation, said shielding having minimal effect on the dimensions of the rotary anode assembly. This is achieved in the X-ray tube according to the invention, which is characterized in that the shielding means comprise a substantially flat shielding plate within the tube housing, which shielding plate extends transversely to said rotation axis and is positioned between the cathode and the emitting surface of the target disk. The efficiency of the shielding according to the invention is explained by the fact that the secondary radiation originates substantially from the emitting surface of the target disk of the rotary anode and is intercepted by the shielding plate in the direct vicinity of its source. Due to the fact that the X-rays are emitted in the $2\pi$ solid angle, substantially orthogonally to the incoming electron beam, the emitting surface of the anode is oblique relative to said beam. It is possible, therefore, to introduce an inner and an outer limit of the emitting surface. The useful X-ray beam will constitute only a part of this $2\pi$ solid angle. The placing of the shielding means according to the invention could be selected in such a manner that the shielding means maximally approach both the emitting surface of the rotary anode and the electron beam from the exterior of the rotary anode assembly. The effective solid angle of the shielding means will be, therefore, optimized. A further embodiment of the X-ray tube according to the invention is characterized in that the shielding means further comprise a ring-shaped projection on the surface of the target disk facing the cathode. This arrangement of the rotary anode will shield the ambient space from the electrons which had undergone a scattering on the emitting surface of the rotary anode together with X-rays which are produced by said electrons. This undesired secondary radiation is emanating in the direction towards the rotating axis of the rotary anode and will be intercepted by the ring-shaped projection on the surface of the rotary anode. A further embodiment of the X-ray tube according to the invention is characterized in that the shielding plate is ring-shaped. This arrangement of the shielding means is conform to the shape of the target disk of the rotary anode. The useful part of the X-ray beam will be transmitted through the tunnel formed between the emitting surface of the target disk of the rotary anode and the shielding plate. It might be advantageous to select the outer diameter of the shielding plate the same as the outer diameter of the target disk of the rotary anode. This arrangement will not enlarge the outer size of the rotary anode assembly and will contribute to the minimization of the X-ray tube dimensions. A further embodiment of the X-ray tube according to the invention is characterized in that the shielding plate is fixed to the rotary anode with fixing means. In this case the target disk of the rotary anode constitutes a bearer of the shielding means and no additional mechanical construction is required to support the shielding means. A further embodiment of the X-ray tube according to the invention is characterized in that the fixing means comprise cylinder-shaped pins attached to the surface of the shielding plate, said pins cooperating with holes in the target disk. Another embodiment of the X-ray tube according to the invention is characterized in that the fixing means comprise rigid projections manufactured on the shielding plate said projections cooperating with notches on the target disk. In both given embodiments of the fixing means it is sufficient to select three fixing positions on the surface of the target disk of the rotary anode, said points being separated from each other by about 120 degrees. In some situations, where the temperature of the target disk of the rotary anode induces the problem for the mechanical stability of the fixing means, one might add a temperature barrier on the back surface of the target disk. This temperature barrier can be implemented by a thermally conductive element with a limited cross-section, said element connecting the back surface of the target disk with each fixing element, respectively.

It might be advantageous to assemble the shielding means to another mechanical bearer than target disk of the rotary anode. A further embodiment of the X-ray tube according to the invention is characterized in that the shielding plate is fixed to the cathode. This embodiment uses the fact that the cathode is stationary with respect to the electron beam and thus to the source of undesired secondary radiation. By fixing the shielding means to the stationary structure, like the cathode, one can further minimize the dimensions of the shielding plate, as the undesired secondary radiation emanates in the limited solid angle. A further embodiment of the X-ray tube according to the invention is characterized in an inner limit of the shielding plate extends to the rotation axis to a distance smaller then a distance between said rotation axis and an inner limit of the emitting surface of the target disk. This construction of the shielding plate effectively shields the ambient space from the scattered electrons and X-rays which are emanating in the direction towards the rotation axis of the rotary anode. This shielding plate can also contain an exterior part which projects towards the outer limit of the target disk of the rotary anode. Evidently, there must be an opening in such shielding plate to transmit the primary electron beam. This exterior part will create a tunnel for the useful part of the X-ray beam in a manner, similar to that of the ring-shaped shielding plate. An advantage of the shielding means arranged in this way, is that the dimensions of the shielding plate can be minimized to substantially cover only the solid angle of the secondary radiation and no further fabrication steps for the rotary anode are required.

BRIEF DESCRIPTION OF THE DRAWINGS

These and other aspects of the invention are discussed using the figures, where the corresponding numerals represent the corresponding parts of the rotary anode assembly.

DETAILED DESCRIPTION OF THE PREFERRED EMBODIMENTS

Figure 1:
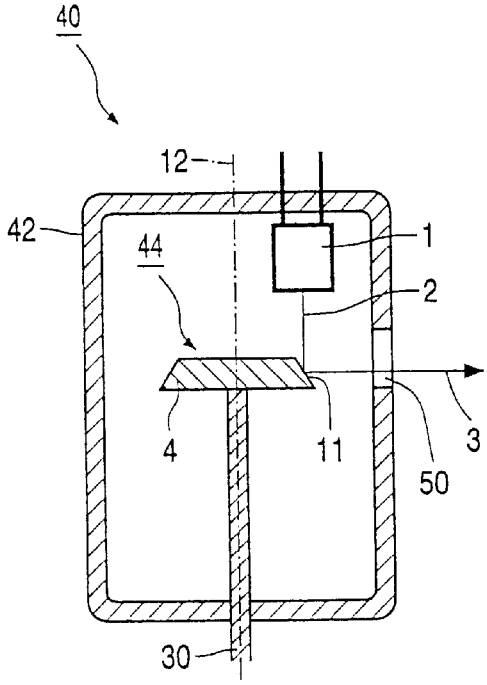
FIG. 1 present a simplified schematic cross-section of an X-ray tube.

A simplified schematic view of an X-ray tube 40 with a rotary anode is given in FIG. 1. In this example the rotary anode 44 together with a cathode 1 are situated within a housing 42. The rotary anode comprises a target disk 4, which rotates about a stationary shaft 30, a rotation axis being depicted by a numeral 12. The cathode 1 emits an electron beam 2, which impinges upon the target disk 4 of the rotary anode 44. The primary electrons deposit their energy in the material of the target disk 4 and the X-rays are produced. The surface on the target disk where the effective production of the X-ray beam takes place is referred to as an emitting surface 11. The useful part of the X-ray beam 3 is transmitted through an exit window 50 and is referred to as an X-ray output of the X-ray tube. For the sake of clarity the shielding arrangement is not shown in this picture.

Figure 2A:
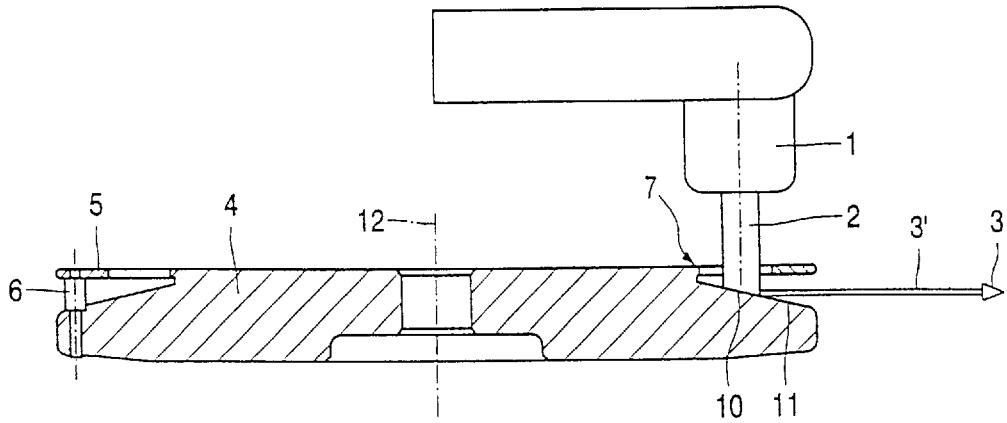
FIGS. 2*a* and 2*b* presents a schematic view of the target disk of the rotary anode together with shielding means according to the invention, where the shielding ring is assembled to the target disk of the rotary anode by means of pins.
Figure 2B:
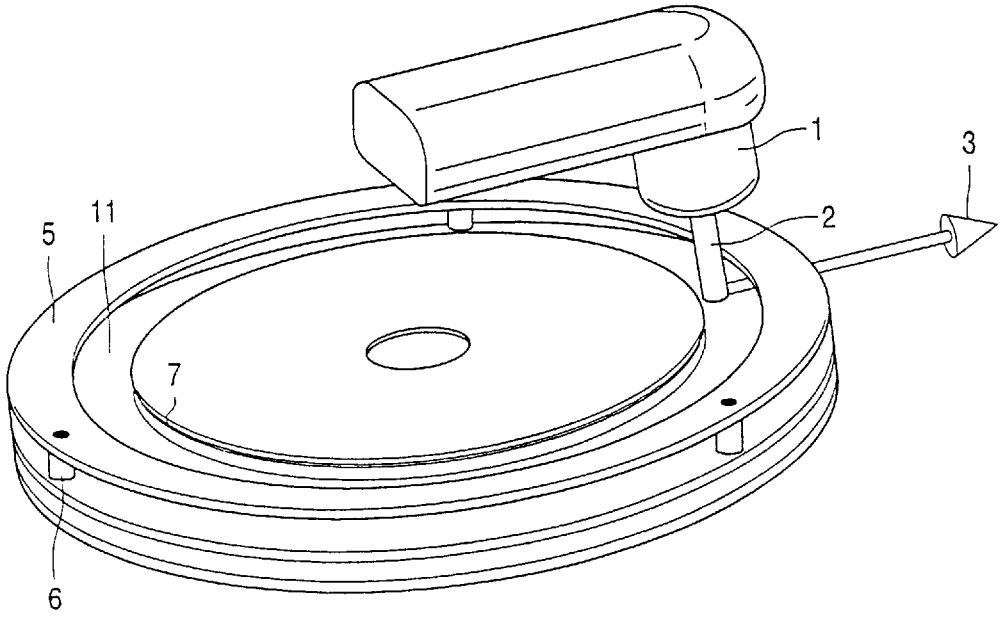

FIG. 2*a* presents a schematic cross-sectional view of the target disk 4 of the rotary anode of FIG. 1 together with shielding means 5. The primary electron beam 2, produced by a cathode 1, impinges on the emitting surface 11 of the target disk 4 at an area called a focal area 10. In the operational condition the target disk of the rotary anode 4 rotates about the rotation axis 12, the focal area 10 is, therefore, a ring. The X-ray beam 3' produced upon the impingement of said electron beam 2 on the emitting surface 11 emanates in a 2π K solid angle, substantially orthogonal to the direction of the electron beam 2. The propagation direction of the useful part of the X-ray beam is schematically depicted by the arrow 3. This component of the produced X-ray beam is further transmitted by an exit window of the X-ray tube, which is not shown in FIG. 2*a*. FIG. 2*b* presents a schematic three-dimensional view of the target disk of the rotary anode 4 together with shielding means according to the invention. In this example the shielding means comprise a shielding ring 5 which is assembled to the target disk of the rotary anode by means of pins 6. It is understood that some of the electrons from the electron beam 4 undergo scattering on the emitting surface 11, so that the undesired secondary radiation comprises these scattered electrons as well as X-ray component, which is produced by these scattered electrons. The target disk of the rotary anode comprises a ring-shaped projection 7 in the direction of the cathode I in order to intercept undesired secondary radiation, propagating in the direction towards the rotation axis 12 of the rotary anode. In this embodiment the shielding ring 5 is assembled on the target disk of the rotary anode 4 and rotates together with it around its rotation axis 12. It is found to be sufficient to fix the shielding ring 5 at three points, separated by about 120 degrees from each other. However, another number of fixation points falls within the scope of the present invention as well.

Figure 3A:
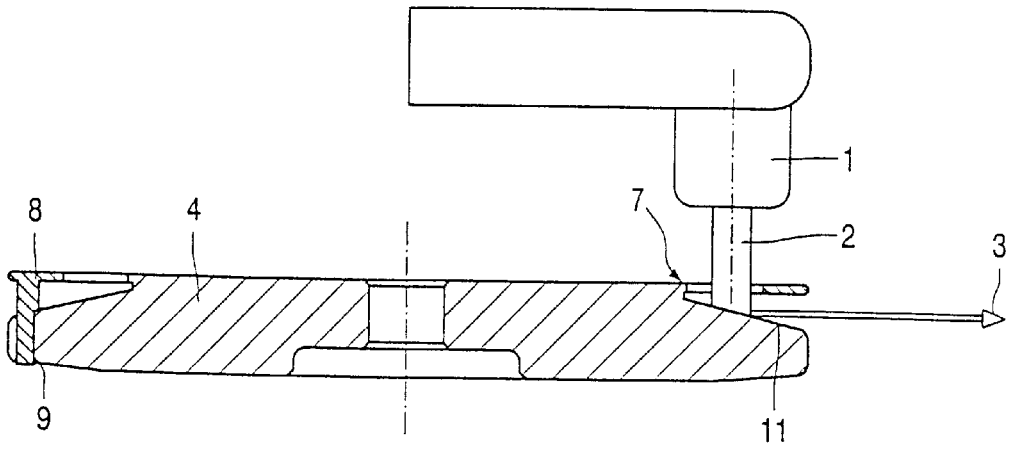
FIGS. 3*a* and 3*b* presents a schematic view of the target disk of the rotary anode together with shielding means according to the invention, where the shielding ring is assembled to the target disk of the rotary anode by means of rigid projections.
Figure 3B:
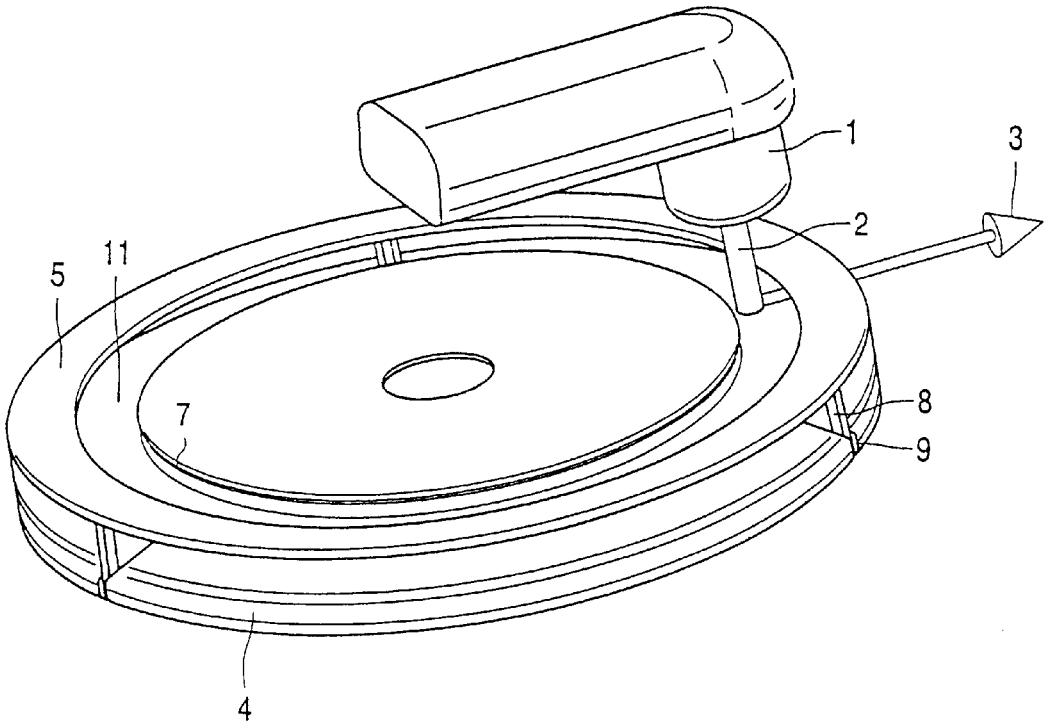

FIG. 3 presents a schematic view of the target disk of the rotary anode 4 together with shielding ring 5 according to the invention, said ring being assembled to the target disk of the rotary anode by means of rigid projections 8. The rigid projections are manufactured on the shielding ring 5 and cooperate with notches 9 manufactured in the body of the target disk 4 of the rotary anode. This example shows three fixation points, separated by about 120 degrees from each other. However, another number of fixation points falls within the scope of the present invention as well.

Figure 4:
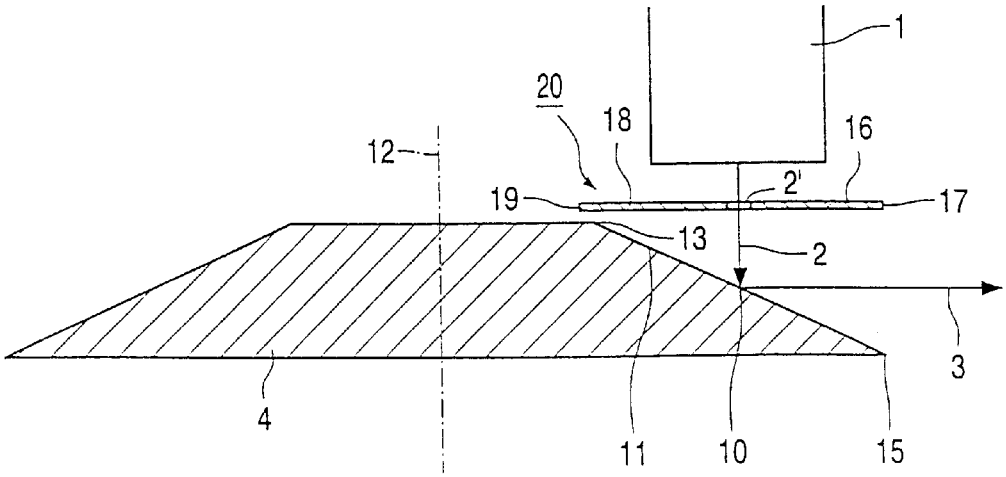
FIG. 4 presents a schematic cross-sectional view of the target disk of the rotary anode together with shielding means according to the invention, where the shielding plate is assembled to the cathode.

FIG. 4 presents a schematic cross-sectional view of the target disk of the rotary anode 4 together with shielding means according to the invention. In this embodiment the shielding means comprise a shielding plate 20 and are assembled to the cathode 1. The electron beam 2, emitted by the cathode 1, is transported through the opening 2' in the shielding plate 20 and impinges on the emitting surface 11 at the focal area 10. The emitting surface is oblique with respect to the propagation direction of the electron beam 2, comprising an inner limit 13 and an outer limit 15. For effective shielding of the undesired secondary radiation the shielding plate 20 is positioned in the direct vicinity of the emitting surface, the latter being substantially the source of the secondary radiation. In order to intercept the secondary radiation propagating in the direction towards the rotation axis 12 of the rotary anode the inner limit 19 of the shielding plate 20 extends to the rotation axis 12 to a distance smaller then the distance between said rotation axis and the inner limit 13 of the emitting surface 11. The useful part of the X-ray radiation is transmitted in the tunnel formed by the shielding plate 20 and the emitting surface 11. For shielding effectively against undesired secondary radiation, it is found to be sufficient that the outer limit 17 of the shielding plate 20 extends to the exterior of the target disk of the rotary anode 4 by substantially the same distance as the distance between the outer limit 15 of the emitting surface II and the rotation axis 12. In FIG. 4 the shielding plate 20 is presented as a flat construction, however it is possible to manufacture the said plate, in such a way that the outer shoulder 16 is transverse to the inner shoulder 18 of the shielding plate 20. The said bend will thus effectively increase the shielding solid angle of the shielding plate 20. This embodiment has the advantage that the shielding plate 20 is stationary with respect to the rotary anode, thus the absolute dimensions of the shielding plate 20 can be minimized, for example down to a segment of a ring. Further, it is also applicable to mount the shielding plate 20 at a distance to the target disk which may be equal or larger as the minimum distance between the cathode 1 and the target disk 4. This might be advantageous to optimize the distance between the cathode and the target disk. The shapes of the shielding plate other than a ring segment fall within the scope of the present invention as well. It is also applicable to shape a cathode 1 with integrated shielding 20.

What is claimed is:

1. An X-ray tube comprising a tube housing, a rotary anode having a target disk (4) rotatable around a rotation axis (12), a cathode (1) for producing a beam of electrons (2) for generating X-rays (3) upon impingement of said beam of electrons upon an emitting surface (11) of the rotary anode (4), shielding means for intercepting undesired secondary radiation originating from said emitting surface, the shielding means comprising a substantially flat shielding plate (5) within the tube housing and a projection (7) on the surface of the target disk (4) facing the cathode (1), said shielding plate extends transversely to said rotation axis (12) and is positioned between the cathode (1) and the emitting surface (11) of the target disk (4).

2. The X-ray tube of claim 1, wherein the shielding means further comprise a ring-shaped projection (7) on the surface of the target disk (4) facing the cathode (1).

3. The X-ray tube of claim 1, wherein the shielding plate (5) is ring-shaped.

4. The X-ray tube of claim 3, wherein the shielding plate is fixed to the rotary anode with fixing means.

5. The X-ray tube of claim 4, wherein the fixing means comprise cylinder-shaped pins (6) attached to the surface of the shielding plate (5), said pins cooperating with holes in the target disk (4).

6. The X-ray tube of claim 4, wherein the fixing means comprise rigid projections (8) manufactured on the shielding plate (5) said projections cooperating with notches (9) on the target disk (4).

7. The X-ray tube of claim 1, wherein the shielding plate (20) is fixed to the cathode (1).

8. The X-ray tube of claim 7, wherein an inner limit (19) of the shielding plate (20) extends to the rotation axis (12) to a distance smaller then a distance between said rotation axis and an inner limit (13) of the emitting surface (11) of the target disk (4).

9. An X-ray tube comprising a tube housing, a rotary anode having a target disk (4) rotatable around a rotation axis (12), a cathode (1) for producing a beam of electrons (2) for generating X-rays (3) upon impingement of said beam of electrons upon an emitting surface (11) of the rotary anode (4), shielding means for intercepting undesired secondary radiation originating from said emitting surface, the shielding means comprising a substantially flat shielding plate (5) within the tube housing and a ring-shaped projection (7) on the surface of the target disk (4) facing the cathode (1), said shielding plate extends transversely to said rotation axis (12) and is positioned between the cathode (1) and the emitting surface (11) of the target disk (4).

10. An X-ray tube comprising a tube housing, a rotary anode having a target disk (4) rotatable around a rotation axis (12), a cathode (1) for producing a beam of electrons (2) for generating X-rays (3) upon impingement of said beam of electrons upon an emitting surface (11) of the rotary anode (4), shielding means for intercepting undesired secondary radiation originating from said emitting surface, the shielding means comprising a substantially flat, ring-shaped shielding plate (5) within the tube housing, said ring-shaped shielding plate extends transversely to said rotation axis (12) and is positioned between the cathode (1) and the emitting surface (11) of the target disk (4).

* * * * *